US011089670B2

(12) United States Patent
Mishin

(10) Patent No.: US 11,089,670 B2
(45) Date of Patent: Aug. 10, 2021

(54) MULTIPLE HEAD LINEAR ACCELERATOR SYSTEM

(71) Applicant: Varex Imaging Corporation, Salt Lake City, UT (US)

(72) Inventor: Andrey V. Mishin, Salt Lake City, UT (US)

(73) Assignee: Varex Imaging Corporation, Salt Lake City, UT (US)

( * ) Notice: Subject to any disclaimer, the term of this patent is extended or adjusted under 35 U.S.C. 154(b) by 0 days.

(21) Appl. No.: 16/586,739

(22) Filed: Sep. 27, 2019

(65) Prior Publication Data

US 2020/0113038 A1 Apr. 9, 2020

Related U.S. Application Data

(60) Provisional application No. 62/740,529, filed on Oct. 3, 2018.

(51) Int. Cl.

| | |
|---|---|
| ***H05H 9/02*** | (2006.01) |
| ***H05H 7/02*** | (2006.01) |
| ***H05H 9/04*** | (2006.01) |

(52) U.S. Cl.

CPC ..... *H05H 7/02* (2013.01); *H05H 9/02* (2013.01); *H05H 9/04* (2013.01); *H05H 2007/025* (2013.01)

(58) Field of Classification Search

CPC .. H05H 7/02; H05H 7/04; H05H 7/06; H05H 7/16; H05H 7/18; H05H 7/22; H05H 9/048; H05H 15/00

USPC ..... 315/5.41, 5.43, 39.51, 500, 502, 505

See application file for complete search history.

(56) References Cited

U.S. PATENT DOCUMENTS

| | | | | |
|---|---|---|---|---|
| 4,667,111 | A * | 5/1987 | Glavish | H01J 37/3171 250/492.2 |
| 5,801,488 | A * | 9/1998 | Fujisawa | H05H 9/00 250/492.21 |
| 6,844,689 | B1 * | 1/2005 | Brown | H05H 7/02 315/39.51 |
| 7,242,158 | B2 * | 7/2007 | Whitham | H05H 7/02 315/5.42 |
| 10,015,874 | B2 | 7/2018 | Mishin | |
| 10,367,508 | B1 * | 7/2019 | Miller | H05H 7/02 |
| 2007/0158539 | A1 | 7/2007 | Zavadlsev | |

(Continued)

FOREIGN PATENT DOCUMENTS

| | | |
|---|---|---|
| CA | 1290470 | * 10/1991 |
| JP | 07-211498 | 8/1995 |
| JP | 2010-509714 | 3/2010 |

OTHER PUBLICATIONS

Search Report mailed in PCT/US2019/053689 dated Jan. 17, 2020.
Written Opinion mailed in PCT/US2019/053689 dated Jan. 17, 2020.

*Primary Examiner* — Tung X Le
(74) *Attorney, Agent, or Firm* — Laurence & Phillips IP Law

(57) ABSTRACT

Some embodiments include a system, comprising: a plurality of accelerator structures, each accelerator structure including an RF input and configured to accelerate a different particle beam; an RF source configured to generate RF power; and an RF network coupled between the RF source and each of the RF inputs of the accelerator structures and configured to split the RF power among the RF inputs of the accelerator structures.

19 Claims, 6 Drawing Sheets

(56) References Cited

U.S. PATENT DOCUMENTS

| | | | | |
|---|---|---|---|---|
| 2007/0297554 | A1* | 12/2007 | Lavie | G21G 1/10 376/190 |
| 2008/0211431 | A1* | 9/2008 | Mishin | H05H 7/12 315/505 |
| 2010/0289436 | A1 | 11/2010 | Alimov | |
| 2014/0049158 | A1* | 2/2014 | Chen | A61N 5/1048 315/5.41 |
| 2014/0152197 | A1* | 6/2014 | Chen | H05H 7/02 315/501 |
| 2015/0245463 | A1* | 8/2015 | Nighan, Jr. | H05H 9/048 378/121 |
| 2017/0238408 | A1* | 8/2017 | Lombardi | H05H 7/04 315/505 |
| 2017/0265292 | A1 | 9/2017 | Mishin | |

* cited by examiner

MULTIPLE HEAD LINEAR ACCELERATOR SYSTEM

BACKGROUND

Non-destructive testing (NDT) and other screening systems may use two x-ray sources. The x-ray sources may be disposed to emit x-rays in orthogonal directions to provide multiple views of a specimen, patient, or object. However, these x-ray sources may be two self-contained x-ray sources. In addition, to reduce cost, one of the x-ray sources may be a lower cost/lower power x-ray source.

DETAILED DESCRIPTION

Embodiments will be described with systems including multiple linear accelerator heads. In some embodiments, when multiple x-ray sources are used, such as when irradiating a specimen, patient, or object from multiple directions, multiple accelerator structures of two x-ray sources may be provided with radio-frequency (RF) power from a single RF source. As will be described in further detail below, the use of the single RF source results in a significant reduction in cost. Alternatively, higher energy x-rays may be generated by both x-ray sources for a similar cost.

Figure 1:
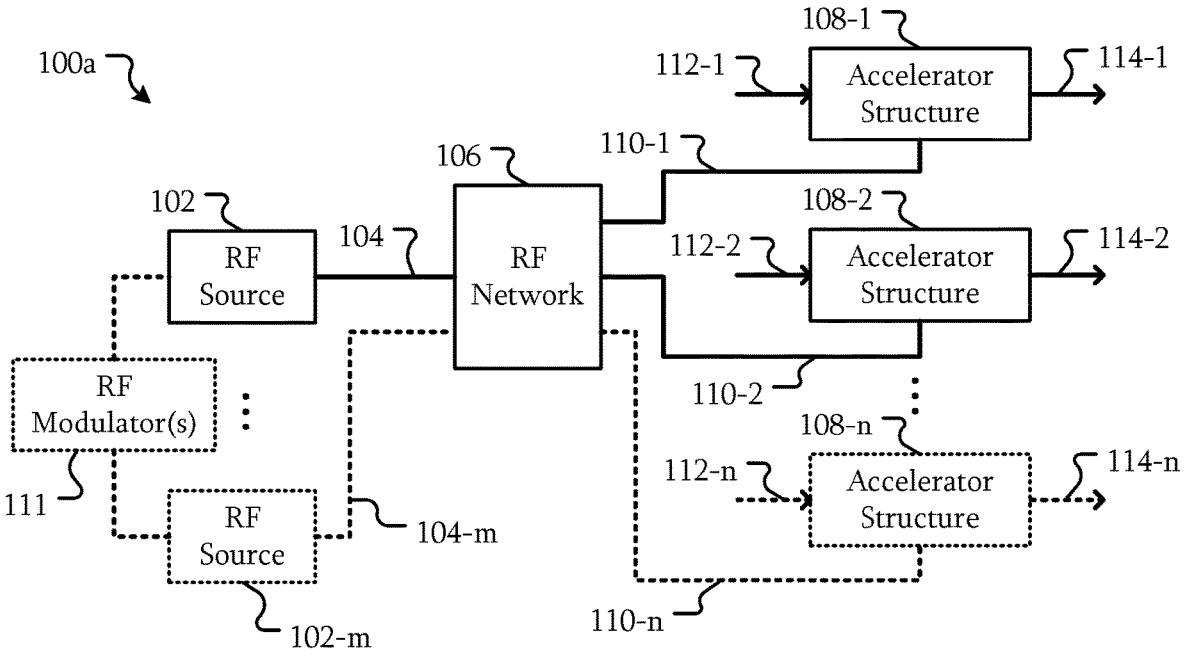
FIGS. 1-6 are block diagrams of multiple head linear accelerator systems with according to some embodiments.

FIGS. 1-6 are block diagrams of multiple head linear accelerator systems with according to some embodiments. Referring to FIG. 1, in some embodiments, a system 100*a* includes an RF source 102, and RF network 106, and accelerators structures 108.

The RF source 102 may be any RF source that may generate RF power 104 with a frequency suitable for a linear accelerator. For example, the RF source may be configured to generated RF power at 3 GHz, 10 GHz, or the like. The RF source 102 may include a magnetron, a klystron, or the like.

The RF network 106 is a network of components such as transmission lines, waveguides, splitters, dividers, regulators, attenuators, circulators, couplers, switches, or the like. The RF network 106 is coupled between the RF source 102 and the accelerator structures 108. The RF network 106 is configured to receive the RF power 104 from the RF source and split the RF power into multiple RF powers 110.

The RF power 104 may be split in a variety of ways including passive and active division of the power. In some embodiments, the RF network 106 is configured to split the RF power substantially equally. For example, splitting the RF power 104 substantially equally includes a power split ratio between 45/55 and 55/45. In other embodiments, the RF network 106 is configured to split the RF power 104 unequally. For example, the power split ratio may be 60/40, 80/20, or the like. In another example, splitting the RF power 104 unequally is a power split ratio less than 45/55 or greater than 55/45. In some embodiments, the power split ratio may be controllable. A variety of examples of different components will be described below that may split the RF power 104 in different ways.

Linear accelerators typically use a particle source configured to generate a particle beam, such as an electron beam. Here, only the accelerator structure 108 of the linear accelerator is illustrated with an input particle beam 112 being generated from another source (not illustrated). The particle beam 112 is directed through the accelerator structure 108. The accelerator structure 108 is a resonant structure that uses an input RF power to accelerate the particles in the particle beam 112. The RF power 110 accelerates the particles to generate the accelerated particle beam 114.

Examples of the accelerator structure 108 include a traveling wave (TW) structure, a standing wave (SW) structure, a hybrid TW-SW structure, or another type of resonant structure. The accelerator structure 108 may include multiple electrodes, waveguide structures, or the like configured to receive the RF power 110 and apply that power to the particle beam 112 to generate the accelerated beam 114.

Here, two accelerator structures 108-1 and 108-2, associated particle beams 112-1 and 112-2, and associated accelerated particle beams 114-1 and 114-2 are used as examples. However, any number of accelerator structures 108 greater than one may be used. Each of those accelerator structures 108 includes an RF input configured to receive RF power 110 that originated from a single RF source 102.

By using one RF source 102, the costs of the system 100*a* may be reduced relative to a system with two independent particle accelerators. However, the resonant frequency of the accelerator structures 108 must be tuned to be within a narrower range that when using particle accelerators with separate RF sources 102. With separate RF sources 102, when manufactured, the tolerance of the resonant frequency of the accelerator structure 108 may be within 0.1% or 1000 parts-per-million (ppm). For example, an accelerator structure 108 with a resonant frequency of 10 gigahertz (GHz) may be tuned to be within 10 megahertz (MHz) of 10 GHz.

In contrast, in some embodiments, the accelerator structures 108 are tuned to be within a narrower range. For example, for accelerator structures 108 with a 10 GHz resonant frequency, the accelerator structures 108 may be tuned to be within 50 kilohertz (kHz), 5 ppm or 0.0005%. In some embodiments, the accelerator structures 108 may be manufactured in match pairs, triples, or n-tuples such that the resonant frequencies of the accelerator structures 108 are matched within such a range.

The addition of the RF network 106 and a potentially higher power RF source 102 may increase the cost of the components of the system 100*a*. In addition, the additional manufacturing processes to create accelerator structure 108 that are tuned to a narrower range may also increase the cost. However, the reduction in cost due to including only one RF source 102 and manufacturing efficiencies due to manufacturing a single system may offset the cost increases, leading to a system 100*a* with a reduced cost or an improved performance for a similar cost.

In some embodiments, for the same cost, the system 100*a* may include two linear accelerators instead of a linear accelerator and a lower power tube-based x-ray source for the same price. However, the linear accelerator may operate at a higher power than the tube-based x-ray source leading to better resolution, penetration, or other performance increases.

In some embodiments, an RF source 102 designed for a system with a single accelerator structure 108 may be capable of outputting sufficient RF power to operate multiple accelerator structures 108. Accordingly, an increase in cost due to increasing the output power of the RF source 102 may be avoided, further reducing the cost of the system 100*a*

Some examples of uses of the system 100*a* include X-ray security screening, in-line X-ray control, dense cargo inspection, sterilization, stereoscopic imaging or the like. In a particular example of cargo security screening with two X-ray sources, the linear accelerators including the accelerator structures 108 may be positioned at 90 degrees to each other to emit x-rays towards two orthogonal sides of cargo.

In some embodiments, the connections among the RF source 102, the RF network 106, and the accelerator structures 108 may be formed using flexible or rigid waveguides. Using flexible waveguides allows for easier placement of the accelerator structures 108.

In some embodiments, a number of RF sources 102 less than the number of accelerator structures 108 may be used with the RF power 104 from the multiple RF sources 102 being combined in the RF network 106 to be distributed to the accelerator structures 108. For example, power from m RF sources 102 may be divided among n accelerator structures 108 where m and n are integers and m is less than n.

In some embodiments, multiple modulators may be part of a system 100*a*. For example, each of the RF source 102 may be associated with a separate modulator. In another example, multiple RF sources 102 may share a modulator. RF modulator(s) 111 represent the one or more modulators.

Figure 2:
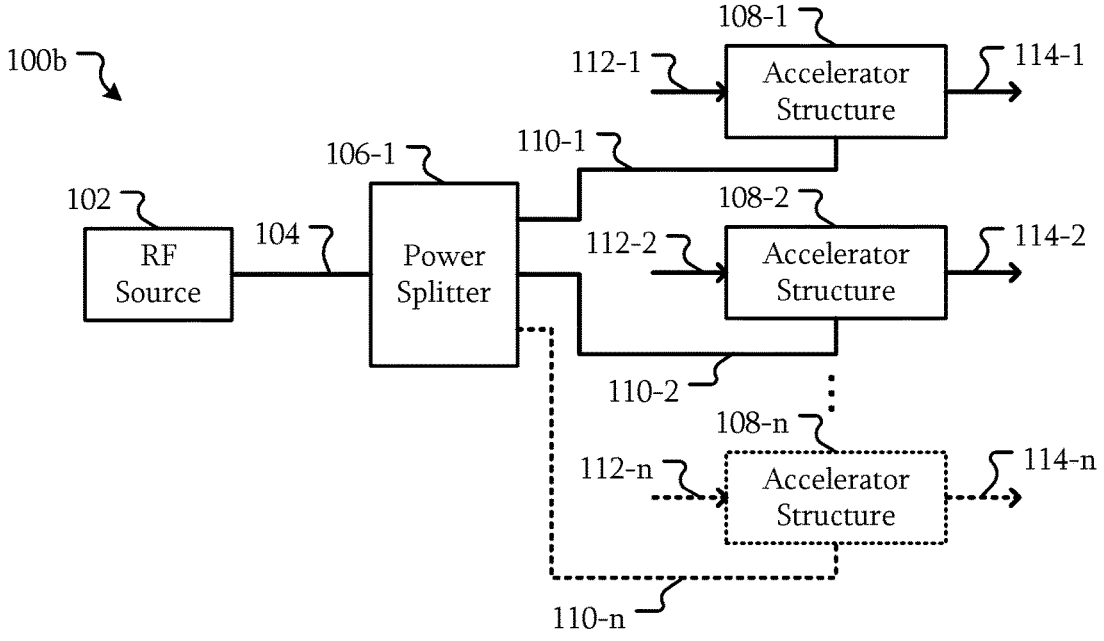

Referring to FIG. 2, in some embodiments, the system 100*b* may be similar to the system 100*a*. However, the RF network 106 includes a power splitter 106-1 configured to split the RF power 104. For example, the power splitter 106-1 may include a three-port, four-port, or k-port waveguide power divider where k is greater than n. The power splitter 106-1 may be a passive waveguide structure tuned to the operating frequency of the RF source 102.

Figure 3:
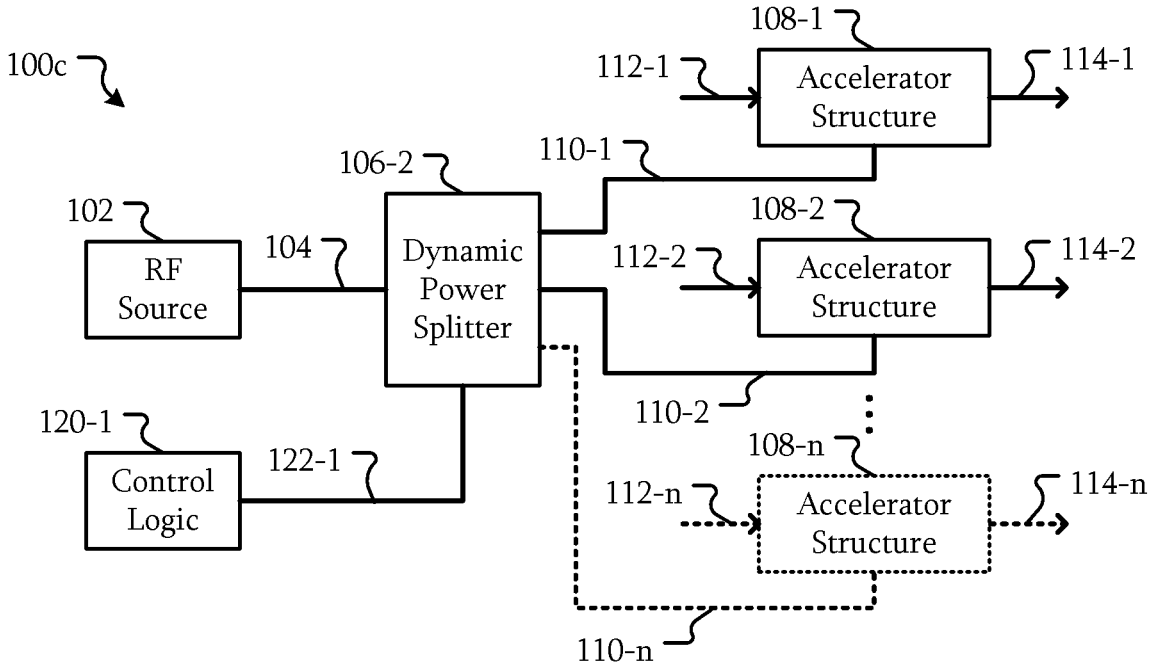

Referring to FIG. 3, in some embodiments, the system 100*c* may be similar to the systems 100*a*-100*b*. However, the RF network 106 includes a dynamic power splitter 106-2 configured to split the RF power 104. The dynamic power splitter 106-2 may be controllable such that the power split ratio of the dynamic power splitter 106-2 is controllable. In some embodiments, the dynamic power splitter 106-2 may include one or more power regulators configured to adjust the ratio of the power split.

The system 100*c* includes control logic 120-1. The control logic 120-1 may include a general-purpose processor, a digital signal processor (DSP), an application specific integrated circuit (ASIC), a microcontroller, a programmable logic array (PLA), device such as a field programmable logic controller (PLC), a programmable logic gate array (FPGA), discrete circuits, a combination of such devices, or the like. The control logic 120-1 may include internal portions, such as registers, cache memory, processing cores, counters, timers, comparators, adders, or the like, and may also include external interfaces, such as address and data bus interfaces, interrupt interfaces, or the like. Other interface devices, such as logic circuitry, memory, communication interfaces, or the like may be part of the control logic 120-1 to connect the control logic 120-1 to the dynamic power splitter 106-2. Although the control logic 120-1 is illustrated as a separate component, the control logic 120-1 may be part of control logic for a larger part of the system 100*c* or control logic for the entire system 100*c*.

The control logic 120-1 may be configured to generate a control signal 122-1. The dynamic power splitter 106-2 may be configured to change the power split ratio in response to the control signal 122-1.

Figure 4:
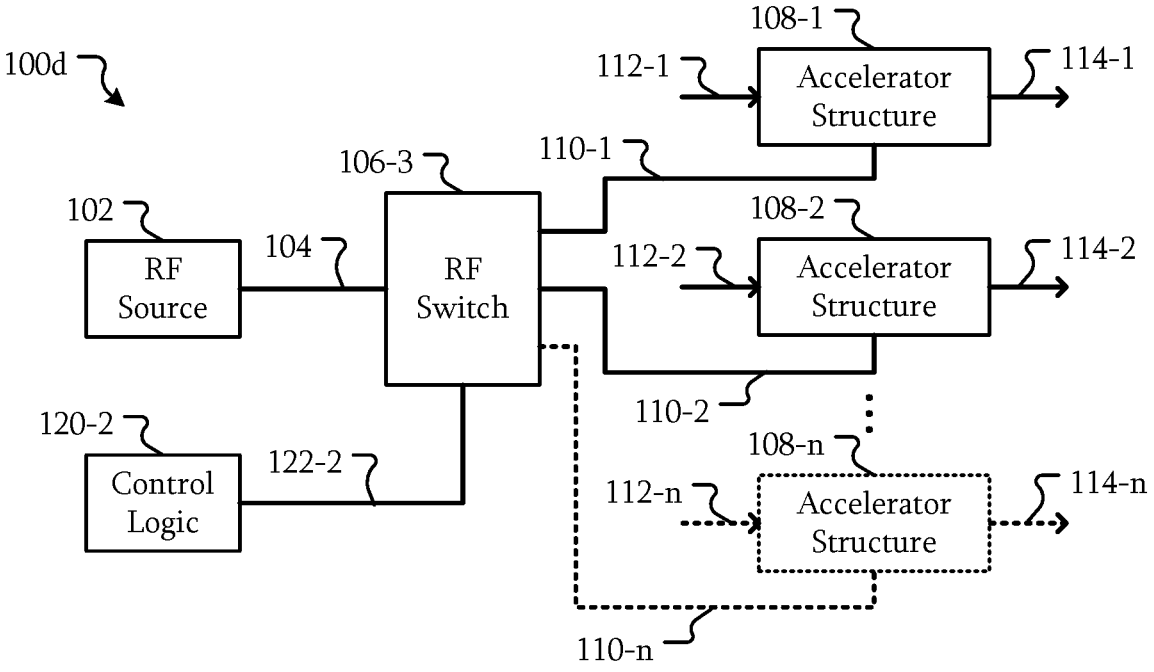

Referring to FIG. 4, in some embodiments, the system 100*d* may be similar to the system 100*a* or the like. However, the RF network 106 includes an RF switch 106-3. The RF switch 106-3 is configured to selectively direct the RF power 104 to one or more of the RF inputs of the accelerator structures 108.

The system 100*d* includes control logic 120-2. The control logic 120-2 may be similar to the control logic 120-1. However, the control logic 120-2 may be configured to generate a control signal 122-2 to cause the RF switch 106-3 to switch the RF power 104 to one or more of the accelerator structures 108. For example, the control logic 120-2 may be configured to control the RF switch 106-3 such that substantially all of the RF power 104 from the RF source 102 is supplied to one of the accelerator structures 108 at a time. Thus, the accelerator structures 108 may not operate at the same time, but over an operating period may operate in a time-division multiplexed manner.

Figure 5:
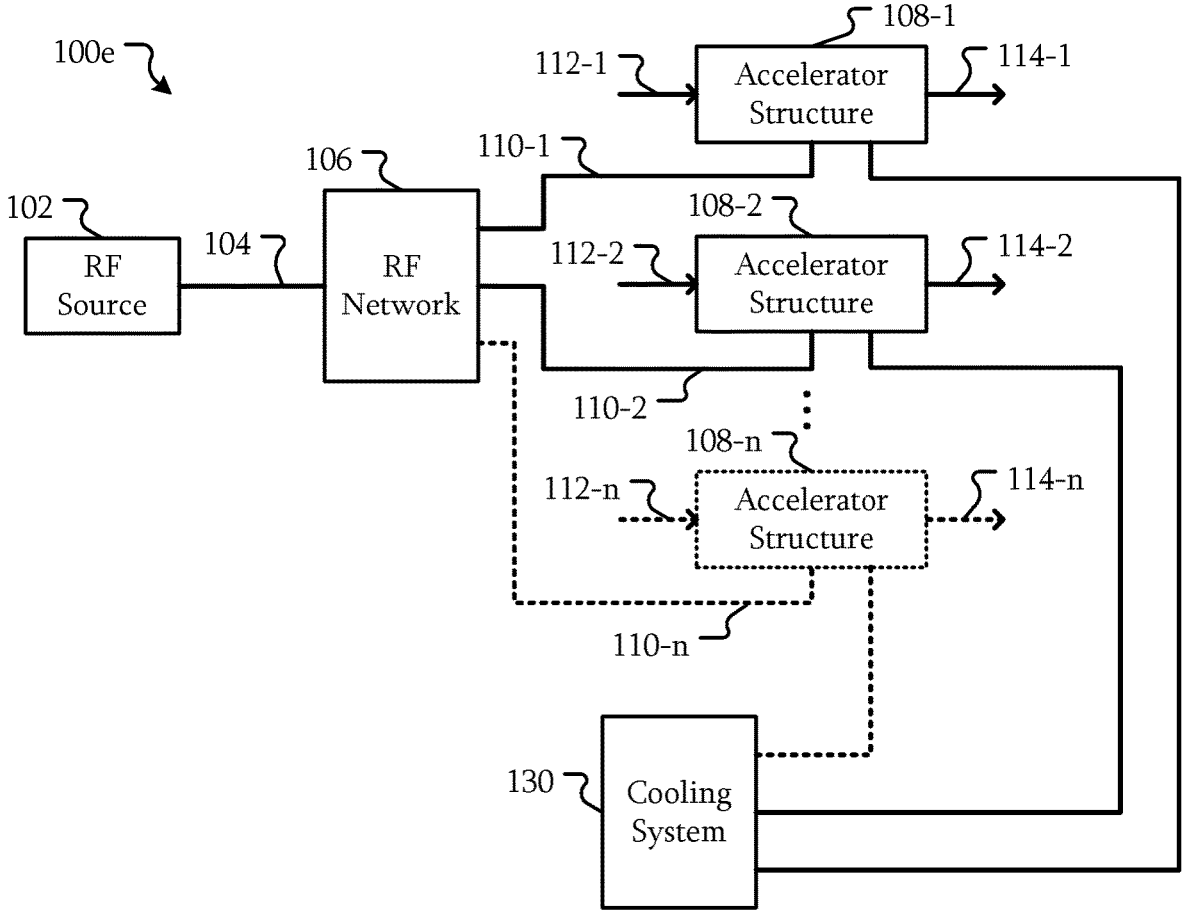

Referring to FIG. 5, in some embodiments, the system 100*e* may be similar to the systems 100*a*-100*d* described above. However, the system 100*e* includes a cooling system 130. The cooling system 130 is coupled to each of the accelerator structures 108. The cooling system 130 may include components such as radiators, pumps, thermoelectric coolers, temperature sensors, valves, tubing, or the like to remove heat from the accelerator structures.

In operation, the accelerator structures 108 may accumulate heat that may be removed by the cooling system 130. The cooling system 130 may be used to remove at least some of that heat to regulate the temperature of the accelerator structures 108. The cooling system 130 may use any variety of cooling media or coolant such as water, oil, air, thermoelectric, or the like.

In some embodiments, an amount of cooling provided to one accelerator structure 108-1 is different than an amount of cooling provided to another accelerator structure 108-2. For example, the accelerator structures 108-1 may be operating at a different power level than the accelerator structure 108-2. In another example, the cooling system 130 may be used to optimize the performance of the individual accelerator structures 108. As the resonant frequency of the accelerator structures 108 may change with temperature, the amount of cooling provided may be used to adjust the resonant frequency to be more aligned with the frequency of the RF power 104. In a particular example, a supply of coolant may be used by the cooling system 130 to cool the accelerator structures 108. While operating, the flow of coolant to each accelerator structure 108 may be independently adjusted, such as by controlling a valve, to optimize the performance of that accelerator structure 108.

In some embodiments, the cooling system 130 may be capable of maintaining a temperature to within a fraction of a degree Celsius (° C.). For example, a resonant frequency of an accelerator structure 108 may drift about 5-10 MHz/° C. Thus, to stay within a 50 kHz operating range, the relative temperature of the accelerator structures may be maintained to be within several hundredths of a degree or less.

Figure 6:
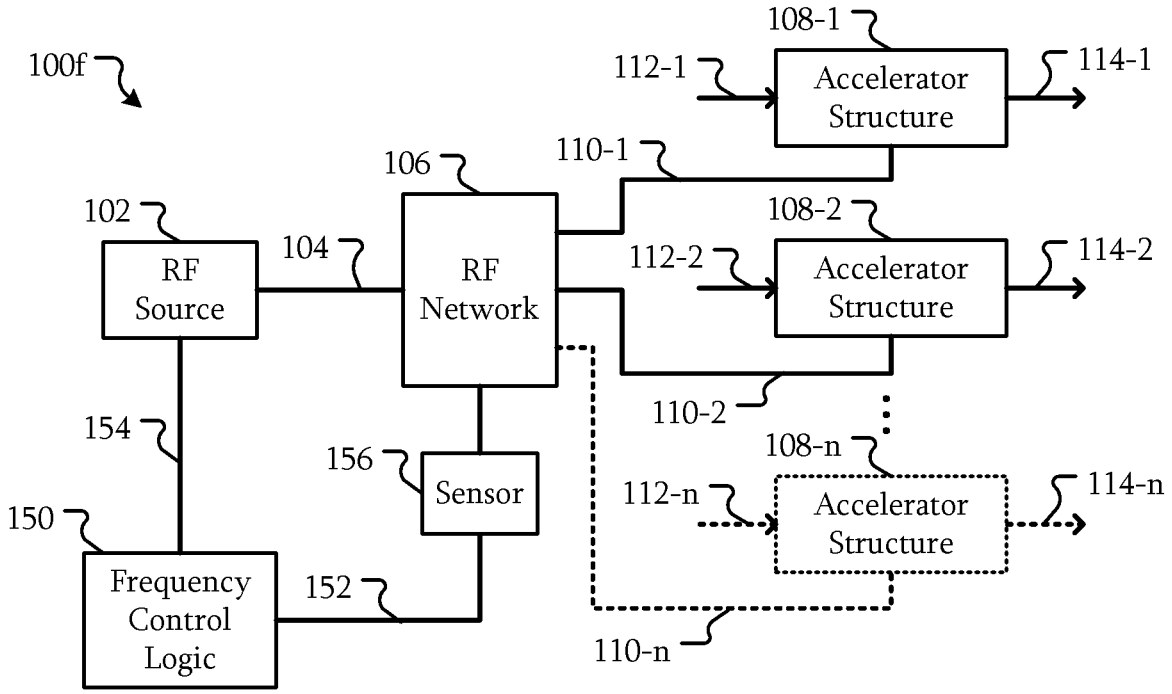

Referring to FIG. 6, in some embodiments, in some embodiments the system 100*f* is similar to the systems 100*a*-100*e* described above. However, the system 100*f* includes frequency control logic 150 and a sensor 156. The sensor 156 coupled is to the RF network 106 and configured to generate a feedback signal 154 based on power reflected from at least one of the RF inputs of the accelerator structures 108. The frequency controller 150 is configured to adjust a frequency of the RF power 104 in response to the feedback signal 154.

For example, the RF source 102 may be a magnetron and the frequency control logic 150 may be configured to control a tuning motor and a tuning slug coupled to the magnetron. In another example, the RF source 102 may be an electrically tunable source, such as a RF driver that provides a signal to a klystron. The frequency control logic 150 may include the electrical tuning circuitry for the RF driver. However, in other embodiments, the RF source 102 may have a different form and may have a different frequency control logic 150.

In some embodiments, the sensor 156 is configured to sense portions of the RF signal 120 to generate a feedback signal 152. The sensor 156 may take a variety of forms. For example, the sensor 156 may include directional couplers, 3 decibel (dB) hybrid couplers, phase shifters, detectors, filters, or the like. Any circuit that can provide a feedback signal 152 that is indicative of a match between a frequency of the RF signal and the resonant frequency of the accelerator structure 104 may be used as the sensor 156. In some embodiments, the feedback signal 152 includes one or more signals representative of a phase shift between a forward and a reflected signal of the RF power 110 associated with one or more of the accelerator structures 108 as sensed by the sensor 156. For example, when the frequency of the RF power 110 is matched to the resonant frequency of the accelerator structure 108, the phase relationship between the forward and reflected RF signals may have a particular value. As the frequency of the RF power 104 and hence the RF power 110 becomes misaligned with the accelerator structure 108, the phase relationship changes. Feedback signal 152 may represent this phase shift and may be used to adjust the RF source 102.

A frequency control logic 150 is configured to receive the feedback signal 152. The frequency control logic 150 may include a general-purpose processor, a digital signal processor (DSP), an application specific integrated circuit (ASIC), a microcontroller, a field programmable gate array (FPGA), a programmable logic array (PLA), a programmable logic device, discrete circuits, a combination of such devices, or the like. The frequency control logic 150 may be configured to implement a variety of control loops, such as a proportional-integral-derivative (PID) control loop.

Figure 7A:
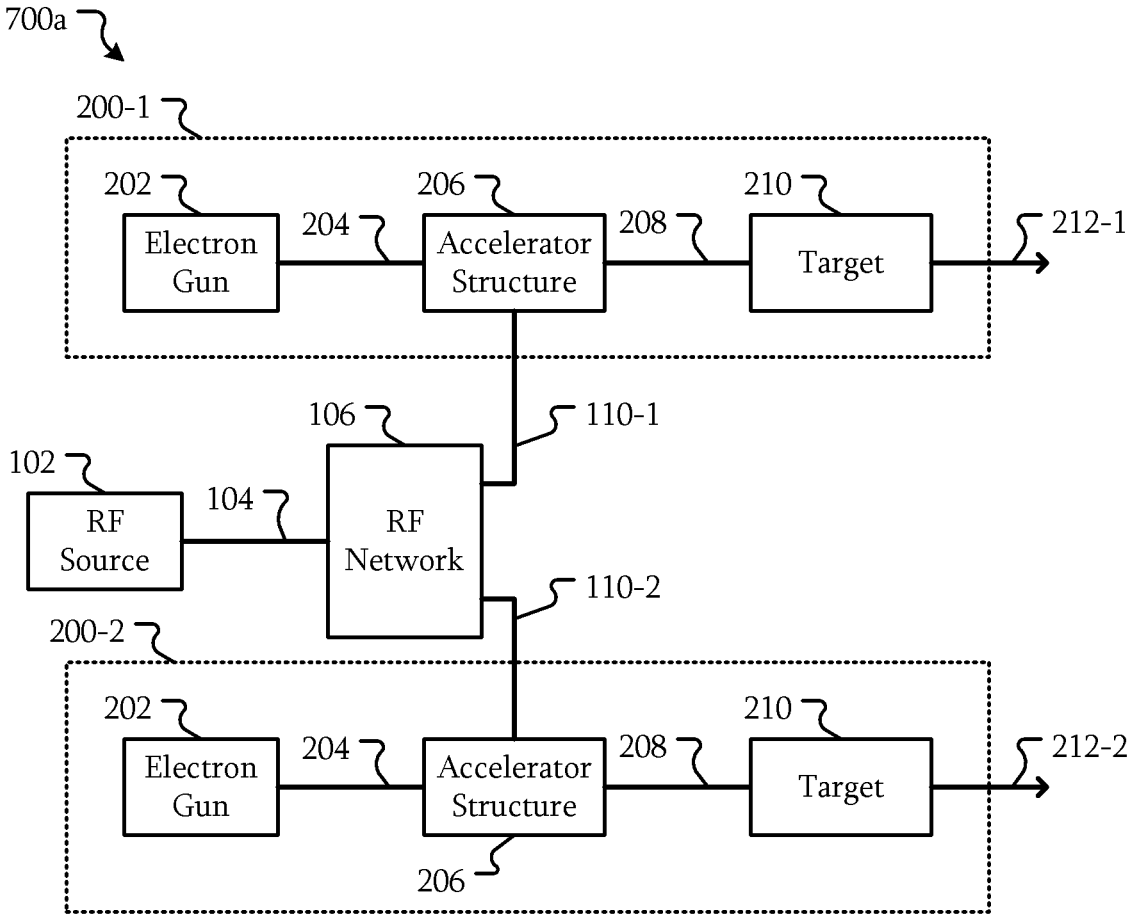
FIGS. 7A-7B are block diagrams of multiple head linear accelerator x-ray systems with according to some embodiments.
Figure 7B:
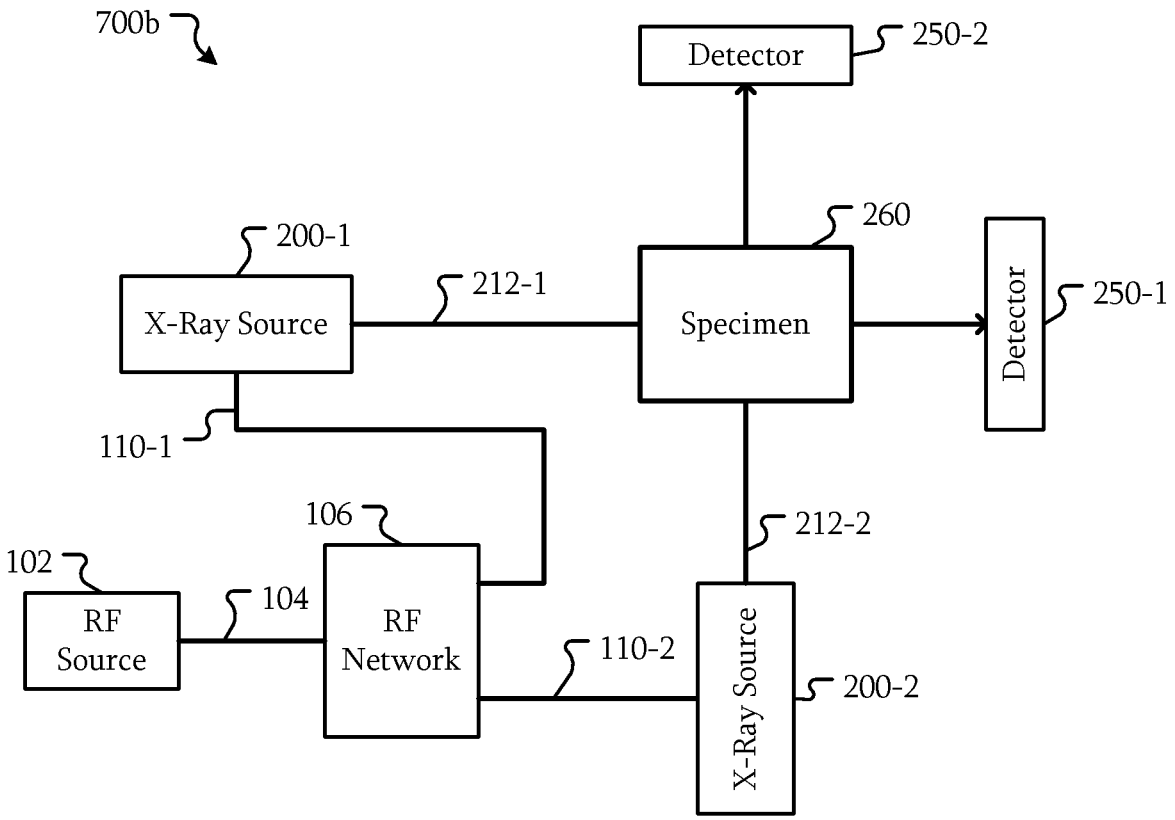

FIGS. 7A-7B are block diagrams of multiple head linear accelerator x-ray systems with according to some embodiments. Referring to FIG. 7A, in some embodiments, the system 700*a* is similar to the systems 100*a-f* described above. the system 700*a* includes multiple x-ray sources 200. Here two x-ray sources 200-1 and 200-2 are illustrated as examples; however, in other embodiments the number of x-ray sources 200 may be greater than two.

Each of the x-ray sources 200 includes an electron gun 202 configured to generate an electron beam 204. The accelerator structure 206 is configured to accelerate the electron beam 204 in response to RF power 110 to generate an accelerated electron beam 208. The accelerated electron beam is directed at a target 210. The target 210 may include any material that may convert incoming electrons to x-rays 212. For example, a material of the target 210 may include tungsten, rhenium, molybdenum, rhodium, other heavy metals, high-Z material, or the like. A high-Z material is chemical element with a high atomic number (Z) of protons in the nucleus.

Referring to FIG. 7B, in some embodiments, a system 700*b* may be similar to the system 700*a* described above. However, in system 700*b*, the first x-ray source 200-1 and the second x-ray source 200-2 are configured to generate orthogonal x-ray beams 212-1 and 212-2. In operation, the orthogonal x-ray beams are 212-1 and 212-2 are disposed to pass through a specimen 260 to respective detectors 250-1 and 250-2. The detectors 250 are devices configured to detect the x-ray beam 212 to generate a signal, such as an image. Although a system 700*b* has been described with orthogonal x-ray beams 212 as an example, in other embodiments, the orientation of the x-ray sources 200 and resulting beams 212 may be different such as the angle between the beams 212 being different, the beams 212 being offset or intersecting, or the like.

Figure 8:
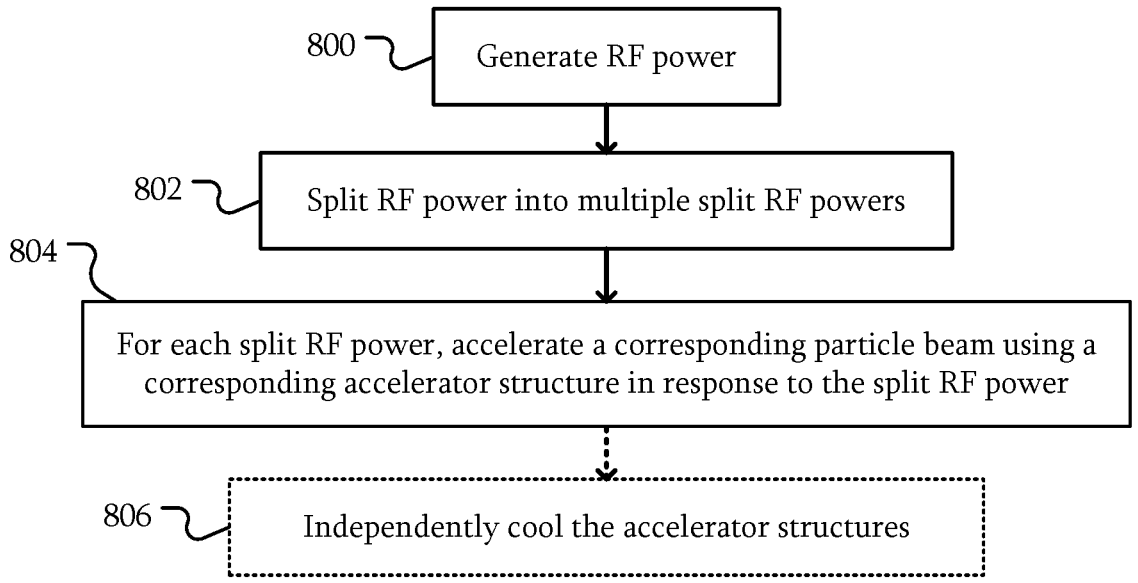
FIG. 8 is a flowchart of an example of operating a multiple head linear accelerator system according to some embodiments.

FIG. 8 is a flowchart of an example of operating a multiple head linear accelerator system according to some embodiments. The system 100*a* of FIG. 1 will be used as an example, but in other embodiments, the operations may be performed by the other systems as described herein or the like. Referring to FIGS. 1 and 8, in 800, RF power 104 is generated. For example, RF power 104 may be generated by one or more RF sources 102 as described above. In 802, the RF power 104 is split into multiple split RF powers 110. For example, an RF network 106 may be used to split the RF power 104 as described above. In 804, for each split RF power 110, an accelerator structure such as accelerator structures 108 or 206 may be used to accelerate a corresponding particle beam 112 in response to the split RF power 110.

In some embodiments, in 806, the accelerator structures 108 or 206 are independently cooled. For example, the cooling system 130 of FIG. 5 may be used to cool the accelerator structures 108 or 206 as described above.

Some embodiments include a system, comprising: a plurality of accelerator structures 108, each accelerator structure 108 including an RF input and configured to accelerate a different particle beam 112; an RF source 102 configured to generate RF power 104; and an RF network 106 coupled between the RF source 102 and each of the RF inputs of the accelerator structures 108 and configured to split the RF power 104 among the RF inputs of the accelerator structures 108.

In some embodiments, the RF network 106 includes a power splitter 106-1, 106-2 configured to split the RF power 104.

In some embodiments, a power split ratio of the power splitter 106-2 is controllable.

In some embodiments, the RF network 106 includes an RF switch 106-3 configured to selectively direct the RF power 104 to one of the RF inputs of the accelerator structures 108.

In some embodiments, the RF network 106 is configured to split the RF power 104 substantially equally among the RF inputs of the accelerator structures 108.

In some embodiments, the RF network 106 is configured to split the RF power 104 unequally among the RF inputs of the accelerator structures 108.

In some embodiments, the accelerator structures 108 comprise a first accelerator structure 108-1 and a second accelerator structure 108-1.

In some embodiments, the first accelerator structure 108-1 is part of a first x-ray source 200-1; the second accelerator structure 108-2 is part of a second x-ray source 200-2; and the first x-ray source 200-1 and the second x-ray source 200-2 are configured to generate orthogonal x-ray beams 212-1 and 212-2.

In some embodiments, a resonant frequency of the first accelerator structure 108-1 is within 0.0005% of a resonant frequency of the second accelerator structure 108-2.

In some embodiments, the system further comprises a cooling system 130 coupled to each of the accelerator structures 108.

In some embodiments, the accelerator structures 108 comprise a first accelerator structure 108 and a second accelerator structure 108; and an amount of cooling provided to the first accelerator structure 108 is different than an amount of cooling provided to the second accelerator structure 108.

In some embodiments, the system further comprises: a sensor coupled to the RF network 106 and configured to generate a feedback signal based on power reflected from at least one of the RF inputs of the accelerator structures 108; and further comprising frequency control logic configured to adjust a frequency of the RF power 104 in response to the feedback signal.

In some embodiments, the system further comprises: a plurality of x-ray sources, each x-ray source including a corresponding accelerator structure 108; and a plurality of detectors, wherein each detector is configured to detect x-rays from a corresponding one of the x-ray sources.

In some embodiments, the RF source 102 is one of a plurality of RF source 102*s* configured to provide power to the RF network 106; and a number of the RF source 102*s* is less than a number of the accelerator structures 108.

Some embodiments include a method, comprising: generating RF power 104 by an RF source 102; splitting the RF power 104 using an RF network 106 into a plurality of split RF power 104*s*; and for each of the split RF power 104*s*, accelerating a corresponding particle beam 112 using a corresponding accelerator structure 108 in response to the split RF power 104.

In some embodiments, the split RF power 104*s* are equal.

In some embodiments, splitting the RF power 104 comprises switching the RF power 104 to generate the split RF power 104*s*.

In some embodiments, the method further comprises independently cooling the accelerator structures 108.

Some embodiments include a system, comprising: a plurality of means for accelerating a particle beam; means for generating RF power; and means for dividing splitting the RF power among the means for accelerating a particle beam. Examples of the means for accelerating a particle beam include the accelerator structures 108 or the like. Examples of the means for generating RF power include the RF source 102. Examples of the means for dividing splitting the RF power among the means for accelerating a particle beam include the RF network 106, power splitter 106-1, dynamic power splitter 106-2, RF switch 106-3, or the like.

In some embodiments, the system further comprises means for independently cooling the plurality of means for accelerating the particle beam. Examples of the means for independently cooling the plurality of means for accelerating the particle beam include the cooling system 130.

Although some embodiments may be described separately, other embodiments, may include combinations of some or all of any of the described embodiments.

Although the structures, devices, methods, and systems have been described in accordance with particular embodiments, one of ordinary skill in the art will readily recognize that many variations to the particular embodiments are possible, and any variations should therefore be considered to be within the spirit and scope disclosed herein. Accordingly, many modifications may be made by one of ordinary skill in the art without departing from the spirit and scope of the appended claims.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description. These additional embodiments are determined by replacing the dependency of a given dependent claim with the phrase "any of the claims beginning with claim [x] and ending with the claim that immediately precedes this one," where the bracketed term "[x]" is replaced with the number of the most recently recited independent claim. For example, for the first claim set that begins with independent claim 1, claim 3 can depend from either of claims 1 and 2, with these separate dependencies yielding two distinct embodiments; claim 4 can depend from any one of claim 1, 2, or 3, with these separate dependencies yielding three distinct embodiments; claim 5 can depend from any one of claim 1, 2, 3, or 4, with these separate dependencies yielding four distinct embodiments; and so on.

Recitation in the claims of the term "first" with respect to a feature or element does not necessarily imply the existence of a second or additional such feature or element. Elements specifically recited in means-plus-function format, if any, are intended to be construed to cover the corresponding structure, material, or acts described herein and equivalents thereof in accordance with 35 U.S.C. § 112 ¶6. Embodiments of the invention in which an exclusive property or privilege is claimed are defined as follows.

The invention claimed is:

1. A system, comprising:

a plurality of accelerator structures having matched resonant frequencies, each accelerator structure including an RF input and configured to accelerate a different particle beam;

an RF source configured to generate RF power;

an RF network coupled between the RF source and each of the RF inputs of the accelerator structures and configured to split the RF power among the RF inputs of the accelerator structures; and control logic coupled to the RF network and configured to control the split of the RF power among the RF inputs of the accelerator structures.

2. The system of claim 1, wherein the RF network includes a power splitter configured to simultaneously split the RF power among the RF inputs of the accelerator structures in response to the control logic.

3. The system of claim 1, wherein the RF network includes an RF switch configured to selectively direct the RF power to one of the RF inputs of the accelerator structures in response to the control logic.

4. The system of claim 1, wherein the RF network is configured to split the RF power substantially equally among the RF inputs of the accelerator structures in response to the control logic.

5. The system of claim 1, wherein the RF network is configured to split the RF power unequally among the RF inputs of the accelerator structures in response to the control logic.

6. The system of claim 1, wherein the accelerator structures comprise a first accelerator structure and a second accelerator structure.

7. The system of claim 6, wherein:

the first accelerator structure is part of a first x-ray source;

the second accelerator structure is part of a second x-ray source; and the first x-ray source and the second x-ray source are configured to generate orthogonal x-ray beams.

8. The system of claim 6, wherein a resonant frequency of the first accelerator structure is within 0.0005% of a resonant frequency of the second accelerator structure.

9. The system of claim 1, further comprising a cooling system coupled to each of the accelerator structures.

10. The system of claim 9, wherein:

the accelerator structures comprise a first accelerator structure and a second accelerator structure; and an amount of cooling provided to the first accelerator structure is different than an amount of cooling provided to the second accelerator structure.

11. The system of claim 1, further comprising:

a sensor coupled to the RF network and configured to generate a feedback signal based on power reflected from at least one of the RF inputs of the accelerator structures; and further comprising frequency control logic configured to adjust a frequency of the RF power in response to the feedback signal.

12. The system of claim 1, further comprising:

a plurality of x-ray sources, each x-ray source including a corresponding accelerator structure; and a plurality of detectors, wherein each detector is configured to detect x-rays from a corresponding one of the x-ray sources.

13. The system of claim 1, wherein:

the RF source is one of a plurality of RF sources configured to provide power to the RF network; and a number of the RF sources is less than a number of the accelerator structures.

14. A method, comprising:

generating RF power by an RF source;

splitting the RF power using an RF network into a plurality of split RF powers in response to control logic configured to control the split of the RF power among the RF inputs of the accelerator structures; and for each of the split RF powers, accelerating a corresponding particle beam using a corresponding accelerator structure in response to the split RF power;

wherein the accelerator structures have matched resonant frequencies.

15. The method of claim 14, wherein the split RF powers are substantially equal.

16. The method of claim 14, wherein splitting the RF power comprises switching the RF power to generate the split RF powers.

17. The method of claim 14, further comprising independently cooling the accelerator structures.

18. A system, comprising:

a plurality of means for accelerating a particle beam having matched resonant frequencies;

means for generating RF power;

means for splitting the RF power among the means for accelerating a particle beam; and means for controlling the split of the RF power among the means for accelerating the particle beam.

19. The system of claim 18, further comprising:

means for independently cooling the plurality of means for accelerating the particle beam.

* * * * *